United States Patent [19]

Howell

[11] 4,288,769

[45] Sep. 8, 1981

[54] AMBIENT TEMPERATURE RESPONSIVE TRIP DEVICE FOR STATIC TRIP CIRCUIT BREAKERS

[75] Inventor: Edward K. Howell, Simsbury, Conn.

[73] Assignee: General Electric Company, New York, N.Y.

[21] Appl. No.: 98,095

[22] Filed: Nov. 28, 1979

[51] Int. Cl.[3] ..... H01H 9/00

[52] U.S. Cl. ..... 335/173; 335/146; 337/140

[58] Field of Search ..... 337/124, 140; 335/78, 335/80, 141, 146, 172, 173, 174, 179, 229

[56] References Cited

U.S. PATENT DOCUMENTS

| | | | |
|---|---|---|---|
| 2,255,638 | 9/1941 | Armstrong | 335/146 |
| 2,926,227 | 3/1960 | Sundt | 335/146 X |
| 3,130,354 | 4/1964 | Burling | 337/124 X |
| 3,206,573 | 9/1965 | Anderson et al. | 335/146 X |
| 3,792,390 | 2/1974 | Boyd | 335/229 |
| 3,810,059 | 5/1974 | Jost | 337/140 X |

*Primary Examiner*—George Harris

*Attorney, Agent, or Firm*—Robert A. Cahill; Walter G. Bernkopf; Philip L. Schlamp

[57] ABSTRACT

A flux shifting circuit breaker trip device includes a permanent magnet for developing a holding flux to create a magnetic force on a plunger sufficient to hold it in its retracted position in opposition to a spring. An electromagnet energized under the control of a static trip unit develops flux in opposition to this holding flux, whereupon the spring becomes overpowering and propels the plunger to its extended position effecting a circuit protective trip function. Temperature responsive means are also included to increase the reluctance in a region of the holding flux path in response to an excessive ambient temperature condition within the breaker enclosure, whereupon the spring becomes empowered to motivate a thermal override trip function.

13 Claims, 3 Drawing Figures

FIG. 1
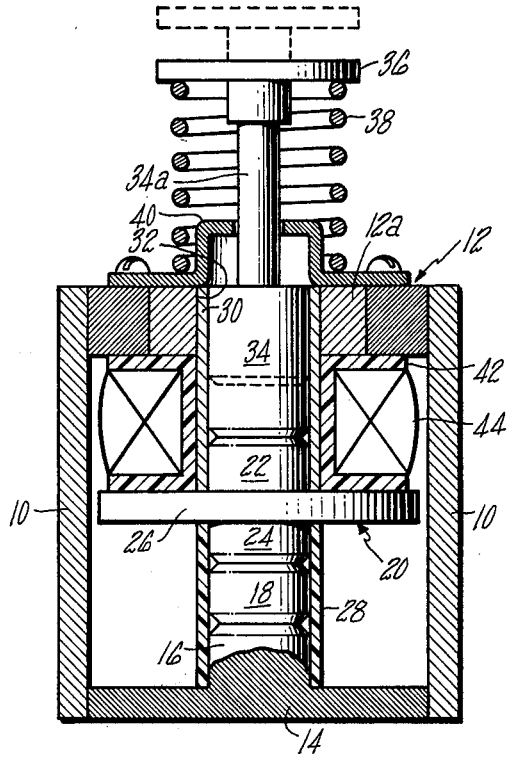
FIG. 2
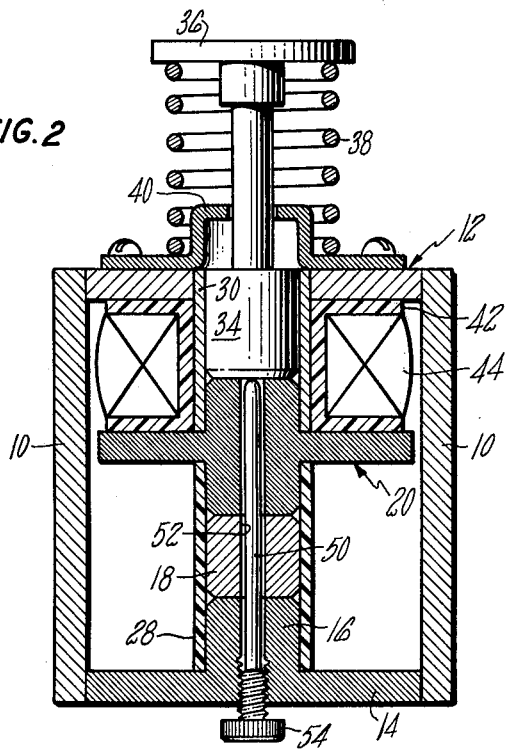
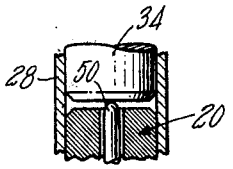
FIG. 3

AMBIENT TEMPERATURE RESPONSIVE TRIP DEVICE FOR STATIC TRIP CIRCUIT BREAKERS

BACKGROUND OF THE INVENTION

The present invention relates to industrial circuit breakers and particularly to a trip initiating thermal override for molded case industrial circuit breakers equipped with static (solid state) trip units.

It is known that a molded case circuit breaker can develop an excessive internal ambient temperature condition even when conducting current well within its current rating. This overheating condition is caused by abnormal losses in the breaker current paths typically occasioned by poor electrical connections or deteriorated breaker contacts.

Circuit breakers equipped with traditional thermal or thermal-magnetic trip units are afforded a reasonable measure of protection against a self-destructive thermal runaway condition since the current heating of the thermally responsive trip element, typically a bimetal, subjected to a rising ambient temperature environment will eventually precipitate tripping of the circuit breaker. Unfortunately, static trip units, now being increasingly implemented in industrial molded case circuit breakers, only respond to the currents flowing in the breaker poles and thus, unlike thermal and thermal-magnetic trip units, are not normally responsive to internal ambient temperature. To afford ambient temperature responsiveness, it is known to equip a static trip unit with a temperature sensor, such as a thermistor, operative to produce a trip signal when overheating occurs. However, this approach to thermal protection relies on the continued operability of the static trip unit whose electronic components are particularly susceptible to damage by high ambient temperatures. Thus, any appreciable time lag in the temperature sensor's response can render the static trip unit totally inoperative to initiate tripping of the circuit breaker.

It is accordingly an object of the present invention to provide a direct acting thermal trip override for static trip circuit breakers.

A further object is to provide a thermal trip override of the above character which utilizes a temperature responsive element operating independently of the trip unit electronics to reliably initiate tripping of a circuit breaker automatically in response to the ambient temperature within the breaker enclosure exceeding a safe level.

An additional object is to provide a thermal trip override of the above character wherein the temperature responsive element is incorporated in and operative to initiate thermal override circuit breaker tripping action of an electromechanical, flux shifting trip device otherwise electrically activated under the control of a static trip unit to initiate a circuit protective trip function.

Other objects of the invention will in part be obvious and in part appear hereinafter.

SUMMARY OF THE INVENTION

In accordance with the present invention, there is provided a thermal override for protecting a molded case static trip circuit breaker from the damaging consequences of overheating by initiating a circuit breaker trip function automatically in response to an abnormal rise in the internal ambient temperature. Pursuant to a signal feature of the invention, the thermal override is incorporated in an electromechanical tripping device normally operative to trip the circuit breaker in response to electrical energization under the control of the static trip unit when an overcurrent condition in the protected circuit is detected. Such electromechanical trip devices are of known construction comprising a plunger which is normally held in a retracted position against the bias of a spring by the holding flux developed by a permanent magnet. To electrically initiate a trip function, the device is equipped with an electromagnet which is energized by a short current pulse to momentarily develop flux in opposition to the holding flux, leaving a diminished magnetic holding force which the spring can overpower. The plunger is thus propelled by the spring to an extended position, in process striking a latch to release the breaker operating mechanism, and the mechanism spring discharges to propel the breaker contacts to an open circuit position culminating a trip function. Such circuit breaker tripping devices are known in the art as flux shifting or flux transfer devices.

In accordance with the present invention, a temperature responsive element is incorporated in a flux shifting device in a manner such as to significantly increase the reluctance in a predetermined region of the holding flux path in response to an abnormally high internal ambient temperature condition. The magnitude of the holding flux flowing in the plunger is thus reduced to the extent that the magnetic holding force on the plunger is no longer sufficient to overpower the spring. Consequently, the spring propels the plunger to its extended position, and the breaker is tripped to interrupt current flow therethrough. The source of the heat is thus removed before thermal damage to the circuit breaker is inflicted.

As an additional feature of the invention, the temperature responsive element further acts to sustain the high reluctance of the region of the holding flux path while the high ambient temperature condition persists, and thus the consequent reduced magnetic holding force is incapable of retaining the plunger in its retracted position when physically returned thereto. The circuit breaker can not therefore be reclosed until the ambient temperature has fallen to a safe level and the temperature responsive element has acted to reduce the reluctance of the holding flux path region.

The invention accordingly comprises the features of construction and arrangement of parts which will be exemplified in the constructions hereinafter set forth, and the scope of the invention will be indicated in the claims.

For a better understanding of the nature and objects of the invention, reference should be had to the following detailed description taken in conjunction with the accompanying drawings, in which:

FIG. 1 is a longitudinal sectional view of a circuit breaker electromechanical, flux shifting trip device incorporating a thermal trip override in accordance with one embodiment of the present invention;

FIG. 2 is a fragmentary longitudinal sectional view of a circuit breaker electromechanical, flux shifting trip device incorporating an alternative thermal trip override embodiment of the present invention; and FIG. 3 is a fragmentary longitudinal sectional view of the trip device of FIG. 2 illustrating the trip initiating operation of the thermal trip override embodiment incorporated therein.

Like reference numerals refer to corresponding parts throughout the several views of the drawing.

DETAILED DESCRIPTION

Referring to FIG. 1, the thermal override of the present invention is incorporated in a circuit breaker flux shifting trip device comprising a frame formed of a magnetically permeable material and consisting of opposed side members 10, an annular upper endwall, generally indicated at 12, and an annular lower endwall 14, all secured in flux coupling relation. Integrally formed with endwall 14 is a pole piece 16 against which a permanent magnet 18 is disposed in abutting relation. The permanent magnet is preferably formed of a cobalt-rare earth material, such as cobalt-samarium. As disclosed in commonly assigned U.S. Pat. No. 3,671,893, cobalt-rare earth magnets have a high coercive force and are exceptionally resistant to demagnetization. A flux diverter, generally indicated at 20, is integrally formed to provide pole pieces 22 and 24 projecting from opposed sides of a larger diameter flange 26 whose periphery is disposed in close proximity to the frame side members 10. For a discussion of the function of a flux diverter in a flux shifting trip device, reference may be had to commonly assigned U.S. Pat. No. 3,693,122.

Still referring to FIG. 1, diverter pole piece 24 is disposed in abutting relation with permanent magnet 18. An insulative sleeve 28 embraces the magnet and pole pieces 16 and 24 to maintain the parts in concentric relation. Diverter pole piece 22 is embraced by a brass sleeve 30 which extends upwardly into close fitting relation with a central opening 32 in endwall 12. This brass sleeve, in addition to cooperating with insulative sleeve 28 in maintaining the concentric positionings of the parts, provides a smooth, non-binding bore reciprocally mounting a plunger 34 having a stem **34*a* extending externally of the frame. The terminal portion of stem 34*a* is threaded to receive cap 36. A helical compression spring 38, captured between the cap and endwall 12, biases the plunger to its extended position, seen in phantom, established by a plunger stop 40 secured to endwall 12. The portion of the brass sleeve intermediate endwall 12 and flux diverter flange 26 is embraced by a bobbin 42 of non-magnetic material on which is wound a coil 44** to provide an electromagnet for effecting electrical actuation of the flux shifting trip device.

In accordance with the well-understood operation of a flux shifting device, as long as the plunger is firmly seated against diverter pole piece 22 in its retracted position, the permanent magnet holding flux flowing in the looped path including the magnet, flux diverter, plunger, and frame develops sufficient magnetic force holding the plunger in its retracted, seated position against the force of spring 38 biasing the plunger to its extended position. When coil 44 is energized with a current pulse originated by an overcurrent or ground fault responsive static trip unit, the resulting electromagnet flux is developed in direct opposition to the permanent magnet flux, causing the opposed holding flux to flow in an alternate path including the flux diverter flange 26, the lower portion of the frame and the air gap between the diverter flange and the frame side members 10. Consequently, the net holding flux flowing through the plunger-diverter pole piece interface is momentarily diminished to the extent that the magnetic force holding the plunger seated in its retracted position no longer overpowers spring 38. This spring is thus empowered to propel the plunger to its phantom-line extended position, in the process striking a circuit breaker latch (not shown) to initiate tripping of the circuit breaker.

To adapt the above-described flux shifting trip device to also function as a thermal override trip device affording thermal protection to the circuit breaker in which it is installed, a thermal responsive member is so incorporated that its response to a high ambient temperature condition acts to insert a high reluctance region in the holding flux path of sufficient magnitude to reduce the permanent magnet holding flux flowing through the plunger-diverter pole piece interface, and thus the magnetic holding force exerted on the plunger is reduced to the extent that spring 38 becomes overpowering. The plunger is then propelled by the spring to its extended position effecting a thermal override trip function.

In the embodiment of the invention seen in FIG. 1, this temperature responsive element is in the form of an annular insert **12*a* incorporated in endwall 12 and formed of a magnetically permeable material having a Curie point correlated with the elevated ambient temperature within the breaker enclosure at which the thermal trip override is to become operative. As is well understood, when the Curie point of a magnetically permeable material is exceeded, its permeability abruptly drops to unity, which is the permeability of air. The material thus imposes a high reluctance, i.e., an apparent air gap, to the flow of flux in a flux path in which it is included. From FIG. 1, it is seen that when insert 12*a* is heated to its Curie point, it abruptly imposes a high reluctance, in the region of the holding flux path between plunger 34 and the remaining outer annular portion of endwall 12. Consequently a significant portion of the magnetic holding flux is forced to flow in the alternate flux path shunting the plunger-diverter pole piece interface afforded by diverter flange 26. The remaining holding flux flowing through this interface develops insufficient magnetic holding force to overpower the spring, and the plunger is propelled to its trip initiating, extended position. I have found that a number of ferrite material compositions identified in the reference text entitled "Soft Ferrites" published in 1969 by Iliffe Books Ltd. of London, England have sufficiently low Curie points as to be applicable in forming insert 12*a***.

In the embodiment of the invention seen in FIGS. 2 and 3, the thermal responsive element is in the form of an elongated rod 50 formed of a material having a high positive temperature coefficient of expansion, such as, for example, brass or zinc. This rod is accommodated in an axial bore 52 formed in endwall 14, pole piece 16 and diverter 20. The lower end of this bore is threaded to receive a plug 54 serving to adjustably position the rod in the bore such that, under normal ambient temperature conditions within the breaker enclosure, the upper end of the rod is disposed just below the plane of the plunger-diverter pole piece interface. As the rod is heated by a rising ambient temperature condition, its consequent elongation progressively displaces the plunger from its seated position to thus create an air gap of increasing width and reluctance in the holding flux path between the plunger and diverter pole piece. As the reluctance of this air gap increases, more and more magnet holding flux is shunted from the plunger through the alternate diverter flange flux path until the diminishing magnetic holding force on the plunger ceases to overpower spring 38. At this moment, the spring becomes empowered to propel the plunger to its extended trip initiating position.

It will be noted in both disclosed embodiments of the invention that until the internal ambient temperature subsides to safe level, the high reluctance inserted in the holding flux path is sustained. Thus, the magnetic holding force available to retain the plunger in its retracted position when physically restored thereto remains insufficient to overpower the spring. Consequently, the circuit breaker can not be reclosed until the circuit breaker has sufficiently cooled down. It will be appreciated that the teachings of the present invention can be utilized to provide a circuit breaker trip device functioning exclusively as a thermal trip override. That is, the trip device need not also be electrically actuable, and thus the electromagnet in the disclosed embodiments may be omitted.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. In an electromagnetic trip device including a plunger reciprocally mounted for movement between a retracted position and an extended position, a spring biasing the plunger to its extended position, a permanent magnet developing a holding flux in a holding flux path including the plunger, the holding flux providing sufficient magnetic holding force on the plunger to hold the plunger in its retracted position against the bias of the spring, and an electromagnet selectively electrically energized to develop flux in the flux path opposing the holding flux whereby the magnetic holding force is diminished to the extent that the spring becomes overpowering and thus acts to propel the plunger to its extended position effective in initiating tripping of a circuit breaker, a thermal trip override comprising a temperature response element acting in response to an excessive ambient temperature condition within a circuit breaker enclosure to increase the magnetic reluctance of the holding flux path at a predetermined location therein, thereby to reduce the magnitude of the holding flux flowing in the plunger and thus reduce the magnetic holding force exerted thereon to the extent that the spring becomes overpowering and the plunger is propelled by the spring to its trip initiating, extended position.

2. The thermal trip override defined in claim 1, wherein the electromagnetic trip device further includes a flux diverter interposed in the holding flux path between the permanent magnet and the plunger, the diverter providing a potential alternative flux path diverting holding flux from the plunger, said temperature responsive element acting to increase the reluctance of the holding flux path in a region thereof located beyond the diverter from the permanent magnet, whereby holding flux is diverted from the plunger through the alternative flux path.

3. The thermal trip override defined in claim 2, wherein said temperature responsive element is in the form of member included in the holding flux path beyond the flux diverter from the permanent magnet and formed of a magnetically permeable material having a Curie point correlated to the ambient temperature at which said thermal trip override is to become operative.

4. The thermal trip override defined in claim 3, wherein said member is formed of a ferrite material.

5. The thermal trip override defined in claim 3, wherein said member is located in the holding flux path beyond the plunger from the flux diverter.

6. The thermal trip override defined in claim 5, wherein the electromagnetic trip device includes a frame of magnetically permeable material for completing the holding flux path loop from the plunger back to the permanent magnet and the alternative flux path from the diverter back to the permanent magnet, said member being incorporated in the frame at a location in the holding flux path adjacent the plunger.

7. The thermal trip override defined in claim 1, wherein said temperature responsive element acts to create an effective air-gap in the holding flux path.

8. The thermal trip override defined in claim 2, wherein said temperature responsive element expands with increasing temperature, said element acting on the plunger to displace it from its retracted position and thereby create an air-gap in the holding flux path between the plunger and the diverter.

9. The thermal trip override defined in claim 8, wherein said temperature responsive element is in the form of an elongated rod formed of a material having a high positive temperature coefficient of expansion, said rod having one end abutting a stationary support and its other end disposed to engage the inner end of the plunger in its retracted position.

10. The thermal trip override defined in claims 1, 2, 3 or 7, wherein said temperature responsive element maintains the increased magnetic reluctance of the holding flux path while the excessive temperature condition prevails, whereby the sustained reduced magnetic holding force is incapable of holding the plunger in its retracted position.

11. A thermal trip override device operative to trip a circuit breaker in response to a high ambient temperature within the circuit breaker enclosure, said device comprising, in combination:

A. a plunger of high magnetically permeable material mounted for movement between a retracted position and an extended position;

B. a spring biasing said plunger to its extended position effective in initiating tripping of the circuit breaker;

C. a permanent magnet for developing holding flux flowing in a magnetic circuit including said plunger, said holding flux developing sufficient magnetic force to hold said plunger in its retracted position against the bias of said spring; and D. temperature responsive means acting in response to a high ambient temperature condition within the breaker enclosure to insert a high magnetic reluctance in said magnetic circuit, whereby to reduce the holding flux flowing in said plunger to the extent that said spring becomes empowered to propel said plunger to its extended position.

12. The thermal trip override device defined in claim 11, which further includes a flux diverter of high magnetically permeable material included in said magnetic circuit intermediate said plunger and said magnet, said flux diverter shunting holding flux from said plunger while said temperature responsive means is acting to insert the high reluctance in the magnetic circuit at a location beyond said diverter from said magnet.

13. The thermal trip override defined in claim 12, which further includes an electromagnet electrically energizable to develop flux in said magnetic circuit opposing the holding flux, whereby to reduce the magnetic holding force on said plunger to the extent that said spring becomes overpowering.

* * * * *